US005572967A

United States Patent [19]

Donaldson, Jr.

[11] Patent Number: 5,572,967

[45] Date of Patent: Nov. 12, 1996

[54] VARIABLE ROLLER VALVE SYSTEM FOR INTERNAL COMBUSTION ENGINE

[75] Inventor: Robert D. Donaldson, Jr., Dallas, Tex.

[73] Assignee: Three Star Enterprises, Inc., Savannah, Ga.

[21] Appl. No.: 296,439

[22] Filed: Aug. 26, 1994

[51] Int. Cl.[6] ..... F01L 5/04

[52] U.S. Cl. ..... 123/190.12; 123/190.2; 123/80 C

[58] Field of Search ..... 123/80 R, 80 BA, 123/80 C, 81 C, 190.2, 190.1, 190.12, 190.4, 190.5, 190.6, 190.8; 251/296, 304

[56] References Cited

U.S. PATENT DOCUMENTS

| | | | |
|---|---|---|---|
| 1,189,625 | 7/1916 | Romberger . | |
| 1,283,121 | 10/1918 | Emery . | |
| 1,443,035 | 1/1923 | Olson . | |
| 3,948,227 | 4/1976 | Guenther | 123/190.4 |
| 3,993,036 | 11/1976 | Tischler | 123/190 A |
| 4,163,438 | 8/1979 | Guenther et al. | 123/80 R |
| 4,481,917 | 11/1984 | Rus et al. | 123/190 C |
| 4,606,309 | 8/1986 | Fayard | 123/190 DL |
| 4,920,934 | 5/1990 | Pizzicara | 123/80 BA |
| 4,949,685 | 8/1990 | Doland et al. | 123/190 A |
| 4,976,227 | 12/1990 | Draper | 123/80 R |
| 5,095,870 | 3/1992 | Place | 123/190.4 |
| 5,105,784 | 4/1992 | Davis et al. | 123/337 |
| 5,205,251 | 4/1993 | Conklin | 123/190.12 |
| 5,309,876 | 5/1994 | Schiattino | 123/190.2 |
| 5,315,963 | 5/1994 | Warf | 123/80 C |
| 5,392,743 | 2/1995 | Dokonal | 123/190.1 |
| 5,448,971 | 9/1995 | Blundell et al. | 123/190.12 |

FOREIGN PATENT DOCUMENTS

| | | | |
|---|---|---|---|
| 0241925 | 9/1990 | Japan | 123/190.1 |
| 3172521 | 7/1991 | Japan | 123/190.1 |
| 284941 | 2/1928 | United Kingdom | 123/190.4 |

*Primary Examiner*—Erick R. Solis
*Attorney, Agent, or Firm*—Fulbright & Jaworski L.L.P.

[57] ABSTRACT

A variable roller valve system for use in an internal combustion engine. A Sliding Iris™ feature provides separate, independent, and continuous control over the aperture sizes of the intake and exhaust valve ports while the engine is running. The valve apertures are constricted and enlarged in a reciprocating motion along the longitudinal axis of the valve rollers so as not to disrupt valve duration. At the same time, and also while the engine is running, hydraulic mechanisms provide separate, independent and continuous control over the relative timing phases of the intake valve train and the exhaust valve train with respect to the crankshaft. As a result, combustion efficiency can be optimized and noxious exhaust emissions can be minimized over a wide range of engine operating speeds and power demands.

11 Claims, 5 Drawing Sheets

VARIABLE ROLLER VALVE SYSTEM FOR INTERNAL COMBUSTION ENGINE

BACKGROUND OF THE INVENTION

This invention relates to a variable roller valve system for use in an internal combustion engine. A traditional feature of such engines is that the apertures and the relative timing of the intake and exhaust valves remain fixed during operation according to pre-adjusted settings. It is well recognized in the art, however, that dynamic control over intake and exhaust flow is required to optimize combustion efficiency and minimize noxious exhaust emissions over a range of operating speeds and power demands. The present invention provides this dynamic control.

The present invention achieves this dynamic control by improving on a basic rotary valve design. A Sliding Iris™ feature provides separate, independent, and continuous control over the aperture sizes of the intake ports and the exhaust ports while the engine is running. At the same time, and also while the engine is running, hydraulic mechanisms provide similar separate, independent and continuous control over the relative timing phases of the intake valve train and the exhaust valve train with respect to the crankshaft.

The result is unprecedented control over the combustion efficiency of the engine. A conventional control means, such as a computer, receives information from the operator, from the engine's environment, and from the engine itself. The control means then interprets the data received and instructs the present invention to adjust for optimum fuel flow and valve phase according to current operating conditions. With proper calibration, optimum combustion conditions can thus be maintained as the engine is operated through varying speeds, load demands and temperatures. This control over combustion provides a significant improvement in efficiency through the widest possible range of engine speeds and load demands, as well as a dramatic reduction in exhaust gas impurities.

The use of roller valves to gain dynamic control over intake/exhaust flow and valve phase is known in the art. Previous inventions have sought to vary roller valve port apertures by circumferential displacement of inner and outer members. Such inventions require elaborate control mechanisms, and potentially disrupt engine timing by altering valve duration. For example, Conklin, U.S. Pat. No. 5,205,251, discloses sleeves over solid rollers constricting valve apertures through relative circumferential displacement. Conklin does not disclose, however, how this displacement is physically actuated or synchronized with crankshaft rotation. Rus et al., U.S. Pat. No. 4,481,917, discloses coaxial annular shutter assemblies, one assembly rotating around the top of each cylinder about the cylinder's own axis. Rus requires a complex gearing mechanism to synchronize the independent operation of the two rotating valve members above each cylinder. Further, both these inventions alter valve duration as the valve port apertures are circumferentially constricted.

In contrast, the present invention's Sliding Iris™ feature varies valve port apertures through longitudinal displacement of inner and outer members. This improves on the prior art by simplifying the required control mechanism and by constricting valve port aperture without altering duration.

SUMMARY OF THE INVENTION

As noted, one object of this invention is to provide improved control over the gas flow dynamics of an internal combustion engine, thereby improving engine performance and fuel economy while reducing exhaust pollutant emission.

A related object of this invention is to improve the mechanical efficiency of an internal combustion engine by lowering mass, by eliminating inertial losses from continually reciprocating parts, and by reducing mechanical friction losses. The rotary valve design disclosed by the present invention weighs significantly less than its traditional "poppet" valve counterpart because there is inherently less material required in its construction. Further, traditional "poppet" valves reciprocate continuously while the engine is running, causing inertial losses not suffered by the present invention. Finally, the friction losses inherent in an engine equipped with traditional "poppet" valves are usually significantly higher than those associated with an equivalent rotary valve design because the "poppet" valve design involves more interrelated moving parts. The present invention, based on a rotary design, thus reduces the engine's mass and its potential for inertial and friction losses, while its improved combustion gas management increases the engine's power potential. Overall mechanical efficiency is therefore improved, further enhancing engine performance and fuel economy.

Another object of this invention is to provide an engine that will operate using alternative fuels to gasoline, such as Liquified Petroleum Gas ("LPG") and other highly oxygenated fuels. These fuels generally combust more thoroughly and cleanly than gasoline, and have a higher octane rating than gasoline. As a result, these fuels achieve greater combustion efficiency than gasoline, with cleaner exhaust emissions. Up until now, however, engines running on these alternative fuels have found difficulty gaining acceptance because these fuels necessarily generate higher thermal shock waves when ignited. Generally, traditional "poppet" valve seats break down rapidly due to continuous direct exposure to these higher thermal shock waves. Valve seat breakdown causes the valve first to leak, and then ultimately to fail. The roller valve design in the present invention has no valve seats.

A further object of this invention is to provide an engine that minimizes cylinder head lubricant leakage through the valve guides and into the cylinders. This feature will reduce the unintentional combustion of lubricant and thereby limit further the creation of noxious exhaust emissions. A disadvantage of traditional "poppet" valve engines is that the valve guide introduces cylinder head lubricant into the cylinder every time the valve opens. This lubricant combusts and creams a noxious exhaust gas. The rotary valve design provided by the present invention allows uniform seals to be used around the variable valve apertures that isolate the apertures from contamination by lubricant. These seals eliminate lubricant leakage into the cylinders from the head.

A further object of this invention is to provide an engine that is easy to manufacture and maintain. As noted, the present invention involves fewer moving parts than a traditional "poppet" valve design. Further, the arrangement of these components into their assemblies is relatively uncomplicated as compared to an equivalent "poppet" valve design. As a result, manufacture is simplified, and maintenance is made easier.

A further object of this invention is to provide a design that calls for a simple retrofit on most existing internal combustion engines. When retrofitting existing engines already manufactured with traditional cylinder heads, the present invention would be provided inside a self-contained replacement cylinder head assembly ideally dimensioned to be interchangeable with the existing one. Upon cylinder head replacement, a minor alteration to the arrangement of the timing belt and its pulleys would be needed to transfer drive power to the overhead roller valve assemblies. Conversion to an alternative fuel system such as LPG, if necessary, is a procedure that is already well known in the art.

Another object of this invention is to further improve combustion efficiency by promoting "swirl" of fuel throughout the cylinder during the intake stroke. At lower engine speeds, the Sliding Iris™ feature of the variable valve design will constrict the aperture through which fuel can be taken into the cylinder. This constricted aperture will cause higher velocity of fuel flow through the aperture, in turn causing turbulence, or "swirl," of the fuel entering the chamber. As a result, the distribution of fuel throughout the chamber will be more uniform, resulting in improved flame propagation and a more complete combustion.

These and other objects of the present invention will be apparent to those skilled in this art from the derailed description of a preferred embodiment of the invention set forth below.

BRIEF DESCRIPTION OF THE DRAWINGS

This invention will be further described in connection with the accompanying drawings, in which.

DETAILED DESCRIPTION OF THE INVENTION

The preferred embodiment herein is directed to a common four cylinder, 4-stroke engine as installed in many automobiles. The present invention is not limited to this application, however, and may be used on any internal combustion engine susceptible to being equipped with roller valves as disclosed herein.

Figure 1:
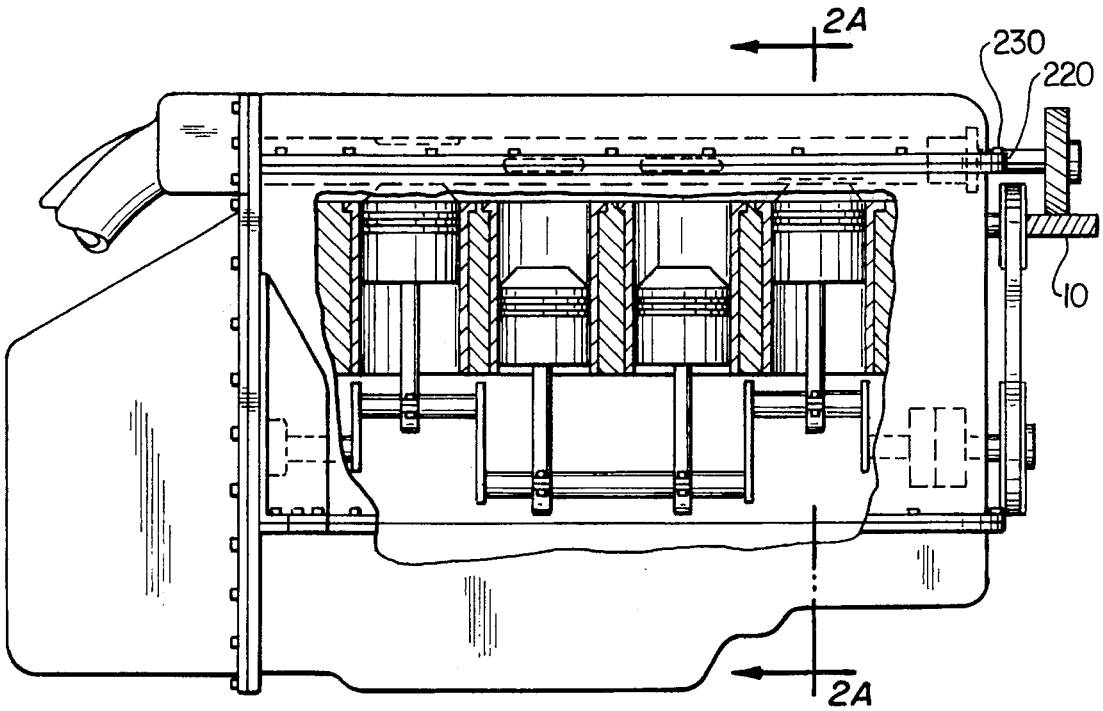
FIG. 1 is a cutaway view from the side into a standard in-line four cylinder, 4-stroke internal combustion engine. The present invention is installed in the cylinder head.
Figure 2A:
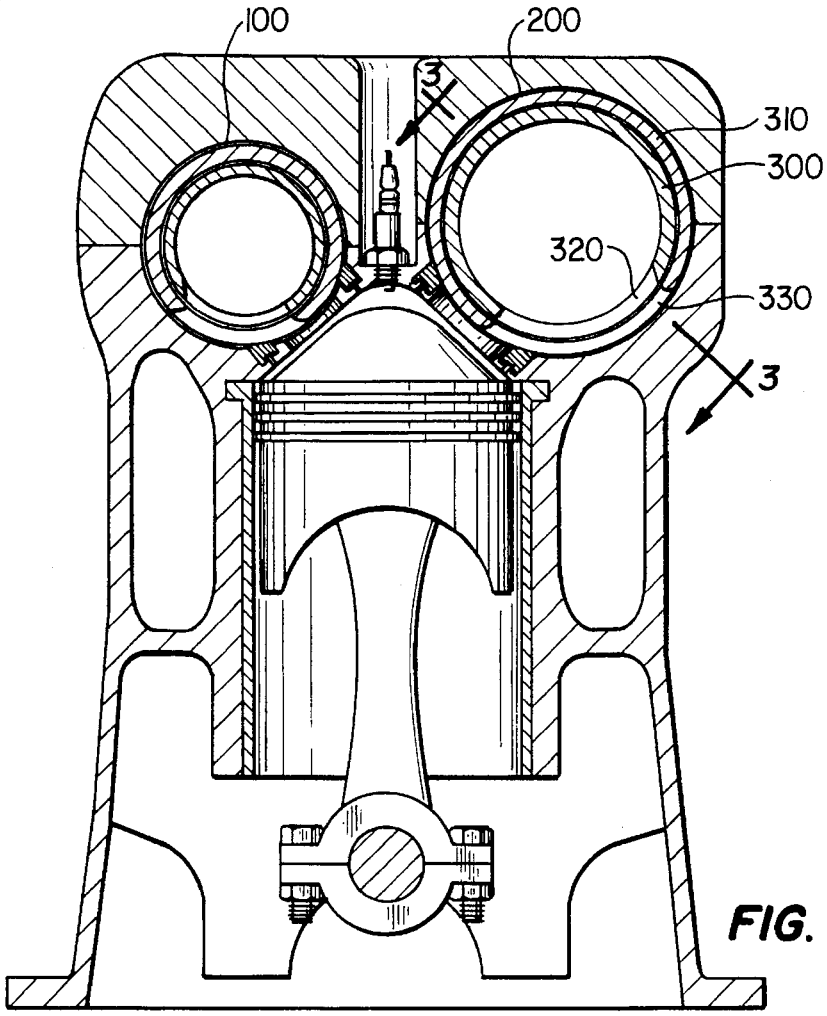
FIG. 2A is a section through the engine as shown on FIG. 1, showing the orientation of the valve rollers at the beginning of the intake stroke.
Figure 2C:
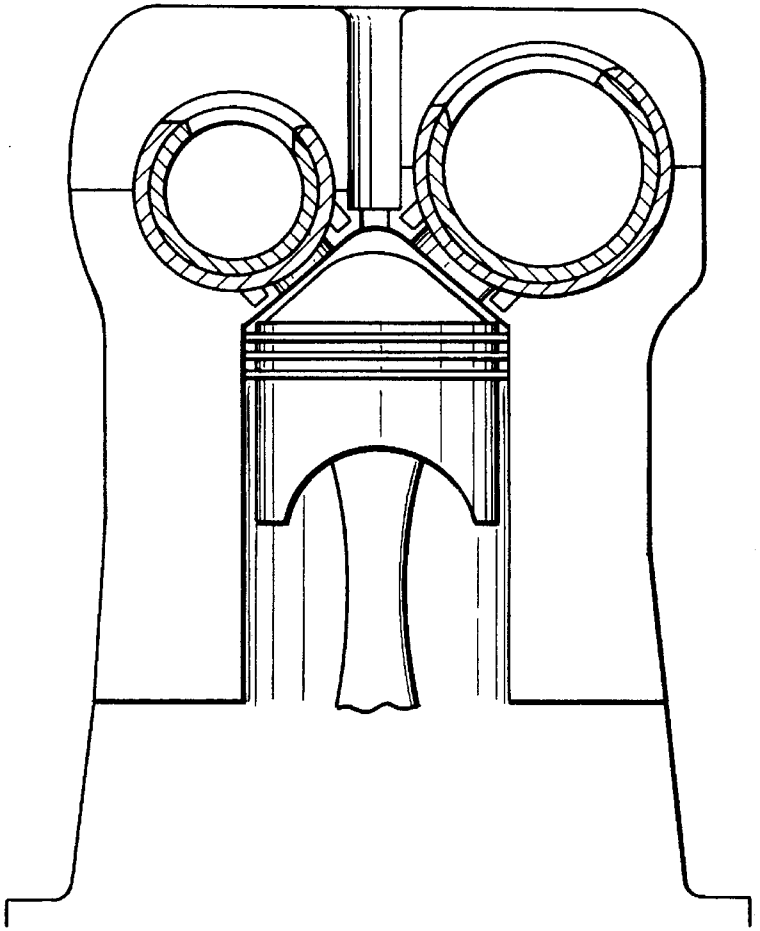
FIG. 2C is a similar view to FIG. 2A, except that the orientation of the valve rollers is now at the top of the compression stroke, preparing for ignition and the beginning of the power stroke.
Figure 2B:
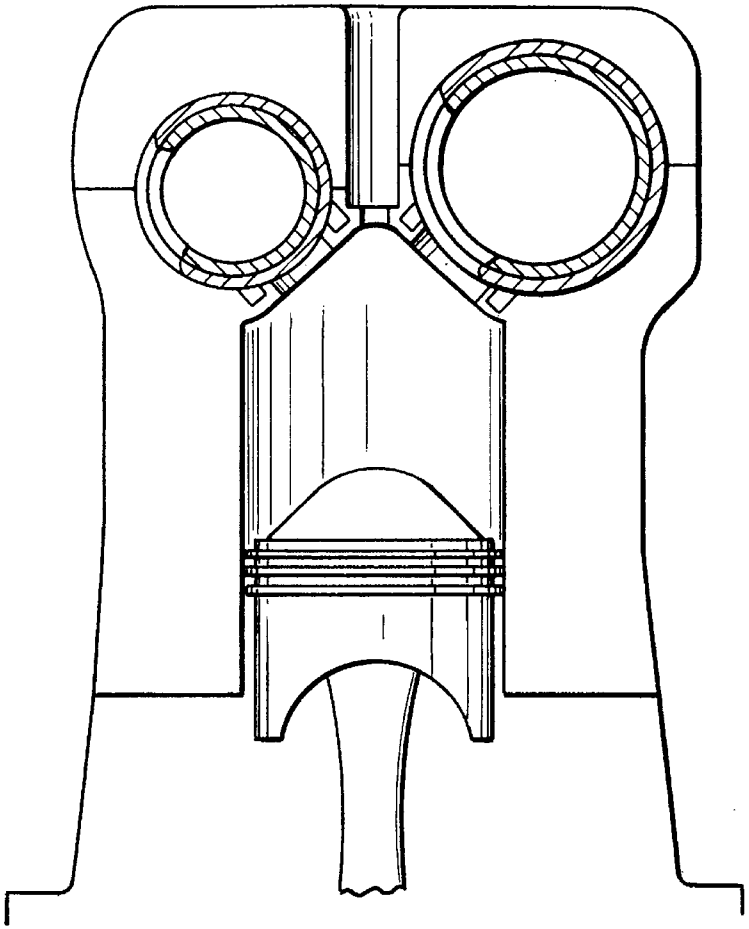
FIG. 2B is a similar view to FIG. 2A, except that the orientation of the valve rollers is now nearing the bottom of the intake stroke, preparing for the beginning of the compression stroke.
Figure 3:
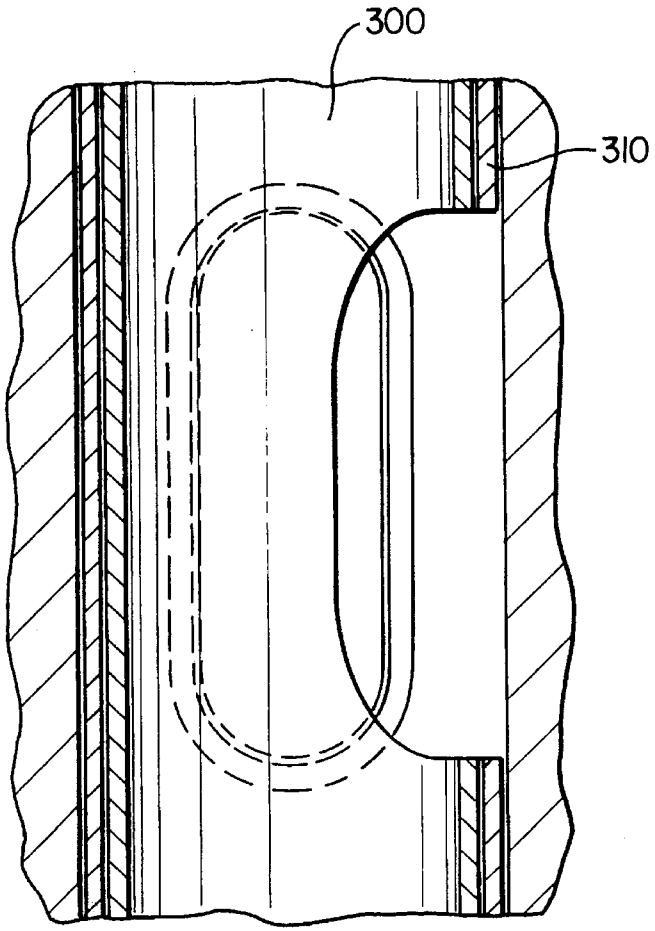
FIG. 3 is a partial section through the intake valve rollers as shown on FIG. 2A, showing a valve port rotating past the dynamic valve seal. In this view, the valve apertures are wide open, and so the inner and outer valve ports are co-located.
Figure 2D:
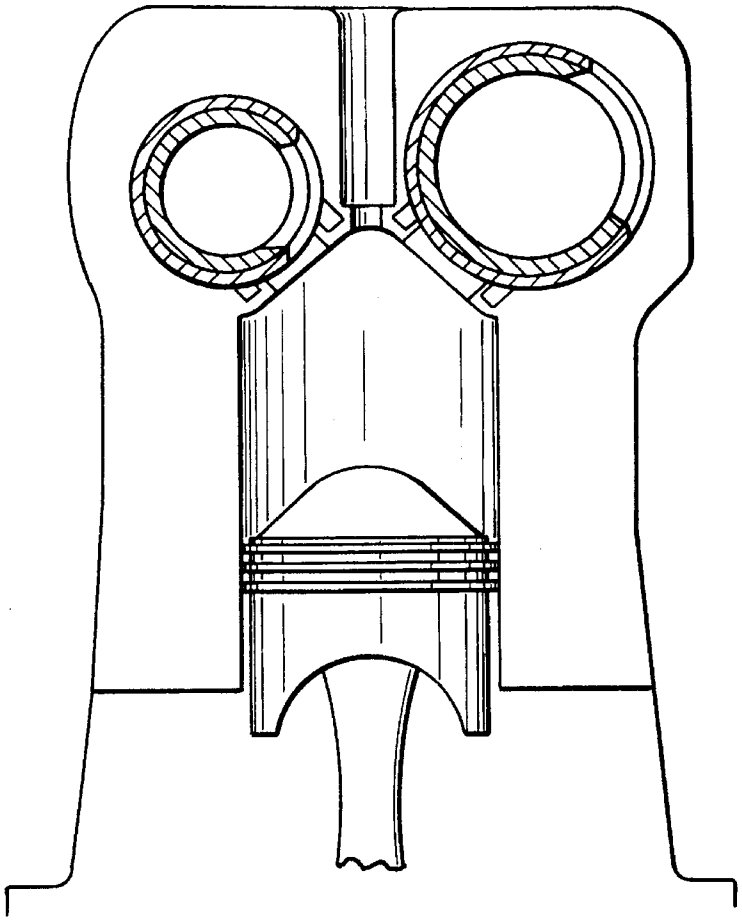
FIG. 2D is a similar view to FIG. 2A, except that the orientation of the valve rollers is now at the bottom of the power stroke, preparing for the beginning of the exhaust stroke.

As shown on FIG. 1 and FIG. 2A, exhaust valve roller assembly 100 and intake valve roller assembly 200 rotate in the cylinder head of the engine to present apertures to the cylinders through which fuel is supplied and exhaust gas is removed. The rotation of valve roller assemblies 100 and 200 is synchronized with the engine crankshaft by linkage means 10. The present invention requires that valve roller assemblies 100 and 200 rotate at one half the speed of the crankshaft. The preferred embodiment of linkage means 10 will drive valve roller assemblies 100 and 200 through gear connector holes 220 and keyways 230. It will be noted below that the present invention discloses a phase control mechanism within roller assemblies 100 and 200 that creates a relative rotational displacement of the valve rollers with respect to the crankshaft. The torque generated by linkage means 10 in driving roller assemblies 100 and 200 must be sufficient to ensure that any relative rotational displacement activated by the phase control mechanism during engine operation actually displaces the valve rollers rather than affecting the steady rotation of the crankshaft.

The components and configurations of exhaust and intake valve roller assemblies 100 and 200 are substantially identical, except that ideally the surfaces of exhaust valve roller assembly 100 that are exposed to hot exhaust gas will be ceramic coated. The present invention has no specific requirement as to surface coating, however.

Also, the preferred embodiment herein discloses intake roller assembly 200 as larger in diameter than exhaust valve roller assembly 100. This feature reflects an expectation that in the four cylinder, 4-stroke engine chosen as the preferred embodiment herein, fuel will be taken into the engine at a lower pressure than the pressure at which exhaust will be driven out, requiring a larger diameter intake roller to provide equivalent intake and exhaust volume capacity. The particular needs of other engine designs fitted with the present invention, however, may dictate other relative roller diameters. The present invention has no specific requirement as to particular relative diameters of exhaust and intake valve roller assemblies 100 and 200.

Figure 4:
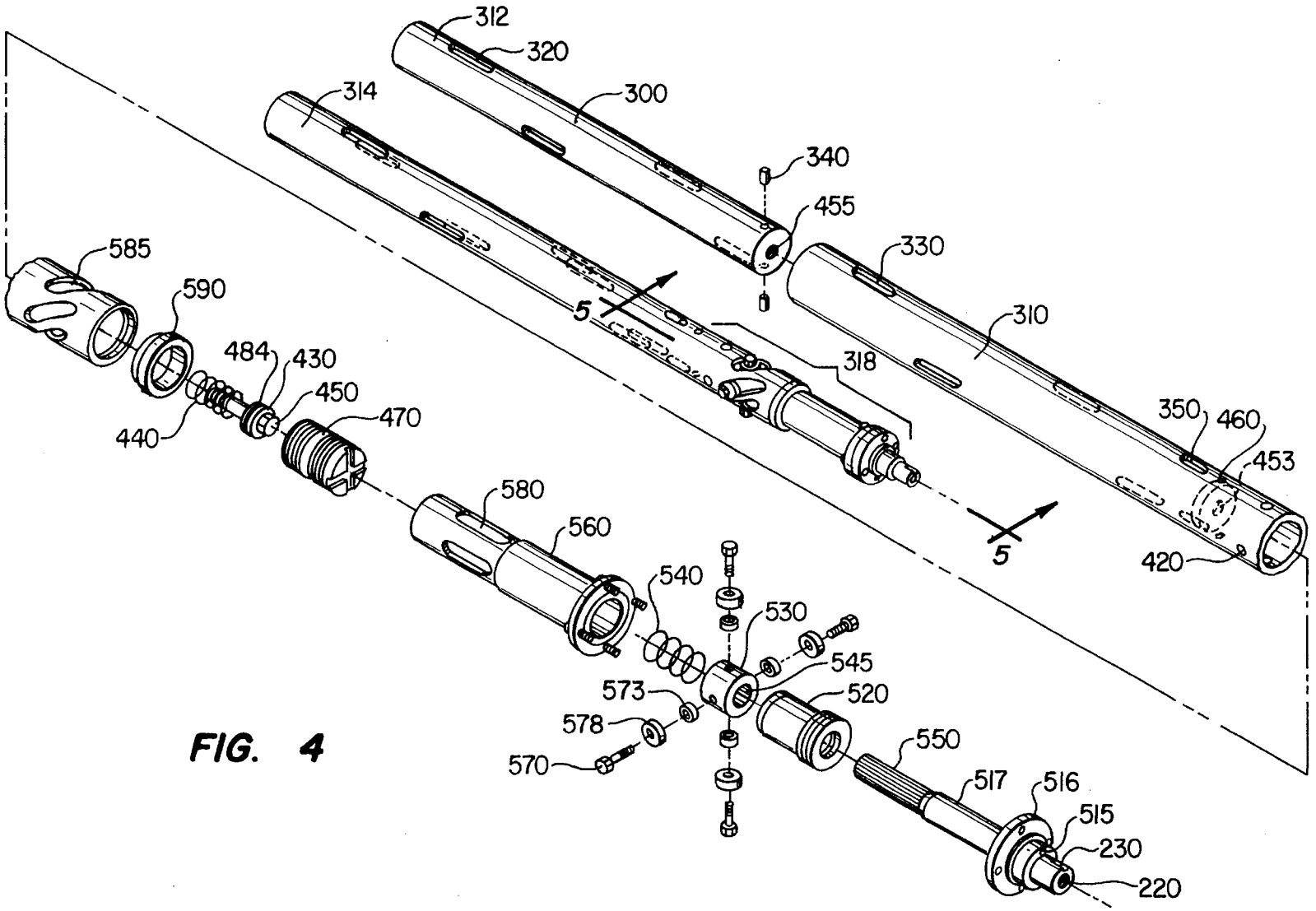
FIG. 4 shows the valve roller assemblies in isolation. The intake valve roller assembly is exploded, while the exhaust valve roller assembly is shown fully assembled. Some standard minor parts such as o-ring seals and spacers from have been omitted from this view for clarity.
Figure 7:
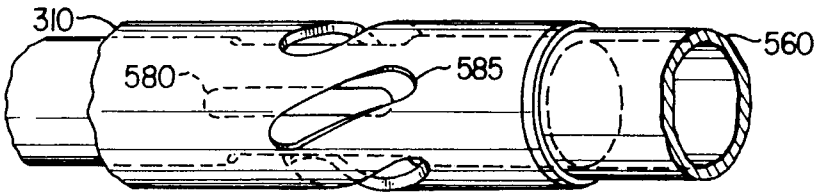
FIG. 7 is a view showing helical phase slots 585 in roller 310 located over longitudinal inner phase slots 580 in phase control casing 560.
Figure 5:
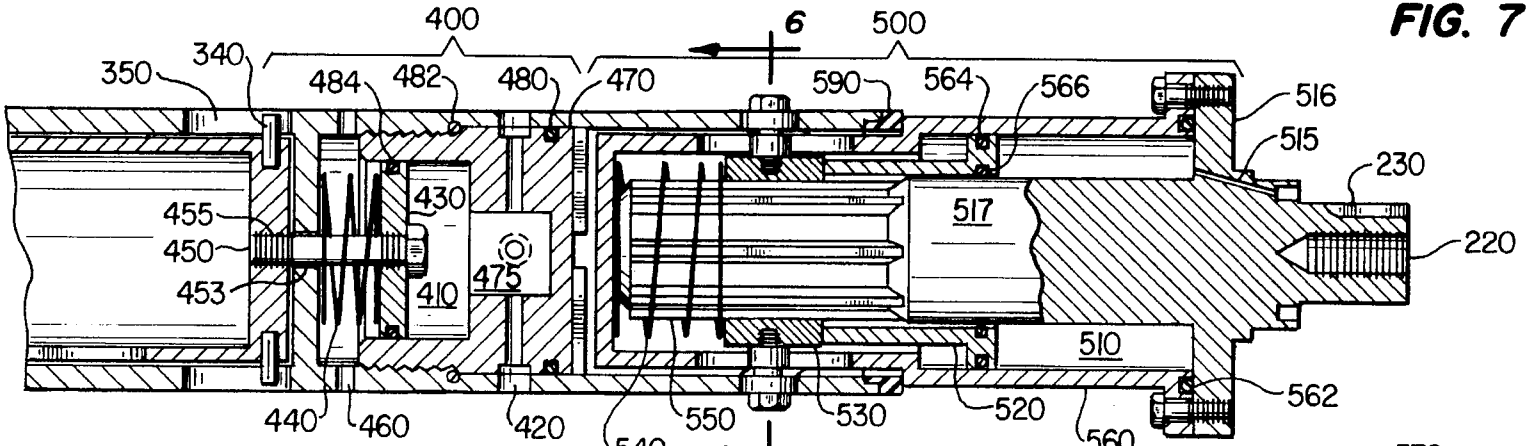
FIG. 5 is a partial section through the fully assembled exhaust valve roller assembly as shown on FIG. 4, showing the hydraulic Sliding Iris™ aperture control mechanism and the hydraulic phase control mechanism as assembled. The details shown on FIG. 5 are typical for both intake and exhaust valve roller assemblies.
Figure 6:
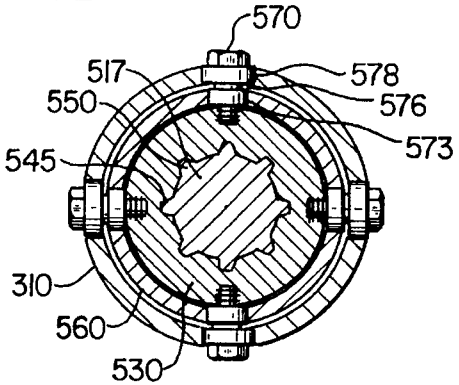
FIG. 6 is a section as shown on FIG. 5, detailing inner and outer bearings 573 and 578 received into their respective phase slots 580 and 585 to generate relative rotational displacement as sliding collar 530 is moved up and down splines 550 on one end of splined member 517.

As is shown on FIG. 4 and FIG. 5, valve roller assemblies 100 and 200 each comprise an inner roller 300 received slidably inside an outer roller 310. Both rollers 300 and 310 are substantially hollow. Both rollers 300 and 310 present open ends 312 and 314 respectively at one end, while at the other end both rollers 300 and 310 are connected to control mechanism assemblies 318.

Rollers 300 and 310 provide inner gas ports 320 and outer gas ports 330 respectively. Gas ports 320 and 330 are substantially identical in size and shape, and are located along the length and around the circumference of rollers 300 and 310 so that they fall at identical corresponding relative positions. The number and the corresponding length and pitch of gas ports 320 and 330 will vary according to the design of engine employing the present invention. Four each of gas ports 320 and 330, one for each cylinder, located along the length and around the circumference of rollers 300 and 310 as shown in FIG. 4 will be required to accommodate the four cylinder, 4-stroke engine chosen as the preferred embodiment herein.

Pins 340 fixed to inner roller 300 are received into roller locating slots 350 in outer roller 310, and prevent relative rotation of rollers 300 and 310 while still permitting relative longitudinal reciprocating displacement. Pins 340 and roller locating slots 350 orient and maintain the relative circumferential position of gas ports 320 and 330 so that gas ports 320 and 330 are always susceptible to being co-located. Pins 340 and roller locating slots 350 also limit the longitudinal displacement of inner roller 300 so that as inner roller 300 slides towards control mechanism assembly 318, further displacement in that direction is prevented when outer gas ports 330 are fully co-located over inner gas ports 320 and present a maximum common aperture to the engine cylinders. The relative longitudinal reciprocating displacement of inner roller 300 with respect to outer roller 310, as limited by the movement of pins 340 within roller locating slots 350, thus creates the Sliding Iris™ feature of the present invention that varies the intake and exhaust valve apertures. When inner roller 300 is located as close to control mechanism assembly 318 as roller locating slots 350 will allow pins 340 to move, gas ports 320 and 330 are fully co-located to present wide open valve apertures to the cylinders. As inner roller 300 slides away from control mechanism 318 along the travel of roller locating slots 350, gas ports 320 and 330 begin to separate longitudinally and gradually decrease the aperture of the valve openings.

As shown on FIG. 4 and FIG. 5, hydraulic aperture control mechanism 400 provides the necessary control over the Sliding Iris™ feature that varies the intake and exhaust valve apertures. Hydraulic fluid enters aperture control chamber 410 under pressure through holes 420 and depresses pressure plate 430 against aperture control return spring 440. Pressure plate 430 displaces inner roller 300 through connector means 450. Connector means 450 attaches rigidly at one end to pressure plate 430, passes slidably through hole 453 in closed end of outer roller 310, and then attaches rigidly at the other end to inner roller 300 through threaded hole 455. Vents 460 in outer roller 310 equalize the pressure differentials in the cavity surrounding aperture control return spring 440 caused by the reciprocating displacement of pressure plate 430.

In order to create aperture control chamber 410, chamber divider 470 is received into outer roller 310. Pressure plate 430 is then received into cylindrical recess 475 within chamber divider 470. Hydraulic o-ring seal means 480, 482, and 484 retain hydraulic fluid within aperture control chamber 410.

Best seen on FIG. 2A, control over the relative timing phases of intake and exhaust valve roller assemblies 100 and 200 is achieved by advancing or retarding the circumferential phase of gas ports 320 and 330 on each valve roller assembly with respect to the crankshaft. A hydraulic phase control mechanism enables the necessary circumferential phase displacement while roller valve assemblies 100 and 200 are rotating during engine operation.

FIG. 4, FIG. 5, FIG. 6 and FIG. 7 show the arrangement of components comprising hydraulic phase control mechanism 500. Hydraulic fluid enters phase control chamber 510 under pressure through hydraulic inlet 515 within cover 516 on splined member 517, displacing annular piston 520 and sliding collar 530 against phase control return spring 540. As shown on FIG. 6, sliding collar 530 provides internal grooves 545 that slidably engage splines 550 provided at one end of splined member 517. Phase control chamber 510 is created when phase control casing 560 receives splined member 517, annular piston 520, sliding collar 530 and phase control return spring 540. Hydraulic o-ring seal means 562, 564, and 566 retain hydraulic fluid within phase control chamber 510.

Fasteners 570 are received into sliding collar 530, and retain inner bearings 573, bearing spacer rings 576, and outer bearings 578 so as to prevent lateral displacement of bearings 573 and 578 but permit free rotation thereof. Inner bearings 573 are received into longitudinal phase slots 580 equally distributed around the circumference of phase control casing 560. Outer bearings 578 are received into helical phase slots 585 provided in outer roller 310. Helical phase slots 585 are of identical curvature, and are distributed around the circumference of outer roller 310 to match the circumferential interval of longitudinal phase slots 580 around phase control casing 560, so that a portion of longitudinal phase slots 580 and helical phase slots 585 are always co-located at an identical position along their respective lengths.

Thrust ring means 590 protects the point of contact between phase control casing 560 and outer roller 310.

It will thus be seen that as hydraulic fluid displaces annular piston 520 and sliding collar 530 down splines 550, inner and outer bearings 573 and 578 are forced to move back and forth within longitudinal phase slots 580 and helical phase slots 585 respectively. The curvature in helical phase slots 585 causes rotational displacement between phase control casing 560 and outer roller 310 as bearings 573 and 578 are moved back and forth. As described above, the torque generated from the crankshaft through linkage means 10 holds phase control casing 560 in steady rotation, forcing outer roller 310 to displace circumferentially as bearings 573 and 578 are moved. A relative rotational phase displacement of outer roller 310 with respect to the crankshaft can thereby be controlled independently for both valve roller assemblies 100 and 200, providing the desired ability to independently advance or retard the inlet and exhaust valve timing while the engine is running.

The invention has been shown, described and illustrated in substantial detail with reference to a presently preferred embodiment. However, it will be understood by those skilled in the art that changes and modifications may be made without departing from the spirit and scope of the invention which is defined by the claims set forth hereunder.

I claim:

1. In an internal combustion engine having a fuel intake manifold, an exhaust manifold, and at least one combustion chamber whose piston is connected to a crankshaft, a variable roller valve assembly, comprising:

an inner roller received slidably inside an outer roller, the inner roller and the outer roller each being substantially cylindrical and substantially hollow, the inner roller and the outer roller each also having an outer circumference, the hollow interior of the inner roller either (1) in fuel flow communication with the fuel intake manifold or (2) in exhaust flow communication with the exhaust manifold;

a linkage means rotatably connecting the outer roller to the engine crankshaft, the linkage means rotating the outer roller with torque from the crankshaft while simultaneously synchronizing the rotation of the outer roller with the rotation of the crankshaft;

at least one inner gas port provided in the inner roller and at least one outer gas port provided in the outer roller, the at least one inner gas port and the at least one outer gas port provided in corresponding pairs, one pair provided for and assigned to each combustion chamber in the engine, each pair of inner gas ports and outer gas ports located on the inner roller and the outer roller respectively such that all pairs of inner gas ports and outer gas ports may be simultaneously co-located when the inner roller is in a predetermined position with respect to the outer roller, the outer roller allowing each outer gas port to be in gas flow communication with its assigned combustion chamber at least once during one complete revolution of the outer roller;

at least one roller locating slot, the at least one roller locating slot provided in the outer roller, the at least one roller locating slot being straight and extending longitudinally along the outer roller;

at least one pin, the at least one pin and the at least one roller locating slot provided in corresponding pairs, each pin connected rigidly to the outside of the inner roller and received slidably within its paired roller locating slot in the outer roller, the pins when received in their roller locating slots preventing relative rotational displacement of the inner roller with respect to the outer roller but nonetheless permitting relative reciprocating longitudinal displacement thereof, said reciprocating longitudinal displacement consisting of reciprocating movement of the inner roller with respect to the outer roller in opposite longitudinal directions, said reciprocating movement arrested by a first limit in one direction and a second limit in the opposite direction, the pins as received within their roller locating slots modulating said reciprocating movement between the first limit and second limit according to the sliding travel of the pins within their roller locating slots, the pairs of pins and roller locating slots located on the inner and outer rollers relative to the pairs of inner gas ports and outer gas ports so that each pair of inner gas ports and outer gas ports become co-located when the reciprocating movement reaches a predetermined choice of either the first limit or the second limit;

a chamber divider received into the outer roller, the chamber divider providing a cylindrical recess in one end, a circular pressure plate received into the cylindrical recess, the pressure plate in contact with an aperture control return spring, the pressure plate also rigidly connected to the inner roller;

a first hydraulic fluid intake means, the first hydraulic fluid intake means available to introduce hydraulic fluid into the cylindrical recess so as to displace the pressure plate and compress the aperture control return spring;

a substantially cylindrical phase control casing received into the outer roller, the phase control casing having an outer circumference and a first end, a thrust ring means located between the phase control casing and the outer roller at their points of contact;

a splined member received into the phase control casing, the splined member having a first end, the splined member providing splines, the splines being straight and extending longitudinally along the splined member at the first end thereof;

an annular piston slidably received over the splined member, the annular piston in communication with a phase control return spring, the annular piston and the phase control return spring being separated by a sliding collar, the sliding collar also slidably received over the splined member, the sliding collar having an inside cylindrical surface and an outside cylindrical surface, the inside cylindrical surface having internal grooves, the internal grooves slidably engaging the splines on the splined member;

a second hydraulic fluid intake means, the second hydraulic fluid intake means available to introduce hydraulic fluid into the phase control casing so as to displace the annular piston against the phase control return spring, the displacement of the annular piston also causing the internal grooves of the sliding collar to slide over the splines;

at least one longitudinal phase slot provided in the outer circumference of the phase control casing and at least one helical phase slot provided in the outer roller, the at least one longitudinal phase slot and the at least one helical phase slot provided in corresponding pairs;

each longitudinal phase slot extending straight between a first end thereof and a second end thereof, each longitudinal phase slot also extending longitudinally along the phase control casing;

each helical phase slot extending arcuately between a first end thereof and a second end thereof according to an identical predetermined arc;

the first ends of all longitudinal phase slots and the first ends of all helical phase slots being oriented towards the first end of the phase control casing, each pair of longitudinal phase slots and helical phase slots located on the phase control casing and the outer roller respectively such that the first end of the longitudinal phase slot and the first end of the horizontal phase slot in all corresponding pairs thereof may be simultaneously co-located when the phase control casing is in a predetermined position with respect to the outer roller;

at least one fastener means, the at least one fastener means rigidly connected to the outside cylindrical surface of the sliding collar, one fastener means being provided for each pair of longitudinal phase slots and helical phase slots, the at least one fastener means located on a pitch around the outside cylindrical surface of the sliding collar to match the pitch of the longitudinal phase slots around the outer circumference of the phase control casing, each fastener means rotatably retaining an inner bearing and an outer bearing, each inner bearing being received into one longitudinal phase slot in the phase control casing, each outer beating being simultaneously received into one helical phase slot in the outer roller;

whereby activation of the first hydraulic intake means causes longitudinal reciprocating displacement between the inner and outer gas ports to constrict or enlarge combined gas port aperture, and activation of the second hydraulic intake means causes rotational displacement of the entire valve roller assembly with respect to the crankshaft, all such displacement available independently and continuously while the crankshaft is rotating the entire valve roller assembly.

2. The variable roller valve assembly of claim 1, further comprising a common hydraulic fluid source, the common hydraulic fluid source simultaneously supplying hydraulic fluid to the first hydraulic fluid intake means and the second hydraulic fluid intake means.

3. The variable roller valve assembly of claim 1, further comprising:

the inner roller having an inner roller surface area, the outer roller having an outer roller surface area; and a heat-resistant coating, the heat-resistant coating applied to a predetermined portion of the inner roller surface area and to a predetermined portion of the outer roller surface area.

4. The variable roller valve assembly of claim 3, wherein the heat-resistant coating is of ceramic construction.

5. In an internal combustion engine having a fuel intake manifold, an exhaust manifold, and at least one combustion chamber whose piston is connected to a crankshaft, a variable roller valve assembly, comprising:

a roller valve assembly, the roller valve assembly being substantially cylindrical in shape, the cylindrical shape thereof having a longitudinal axis, the roller valve assembly including an inner roller received slidably within an outer roller, the inner roller providing at least one inner gas port therein, the outer roller providing at least one outer gas port therein, the roller valve assembly being either (1) in fuel flow communication with the fuel intake manifold or (2) in exhaust flow communication with the exhaust manifold;

a linkage means rotatably connecting the roller valve assembly to the engine crankshaft, the linkage means driving the roller valve assembly with torque from the crankshaft while simultaneously synchronizing the rotation of the roller valve assembly with the rotation of the crankshaft;

at least one valve opening provided in the roller valve assembly, each valve opening formed by one outer gas port and one inner gas port assuming a degree of co-location, the number of valve openings equal to the number of combustion chambers in the engine, each valve opening assigned to one combustion chamber, the roller valve assembly allowing each valve opening to be in gas flow communication with its assigned combustion chamber at least once during one complete revolution of the roller valve assembly; and means for constricting or enlarging the aperture of the valve openings by displacing the inner roller with respect to the outer roller in a reciprocating motion along the longitudinal axis of the roller valve assembly such that the inner gas ports and the outer gas ports assume varying degrees of co-location;

whereby combustion gas flow of in or out of the cylinder may be controlled by varying the aperture of the valve openings.

6. The variable roller valve assembly of claim 5, wherein the means for constricting or enlarging the aperture of the valve openings in a reciprocating motion along the longitudinal axis of the roller valve assembly includes:

the inner roller and the outer roller both being substantially hollow;

the at least one inner gas port in the inner roller and the at least one outer gas port in the outer roller provided in corresponding pairs, one pair provided for and assigned to each combustion chamber in the engine, each pair of inner gas ports and outer gas ports located on the inner roller and the outer roller respectively such that all pairs of inner gas ports and outer gas ports may be simultaneously co-located when the inner roller is in a predetermined position with respect to the outer roller;

at least one roller locating slot, the at least one roller locating slot provided in the outer roller, the at least one roller locating slot being straight and extending longitudinally along the outer roller;

at least one pin, the at least one pin and the at least one roller locating slot provided in corresponding pairs, each pin connected rigidly to the outside of the inner roller and received slidably within its paired roller locating slot in the outer roller, the pins when received in their roller locating slots preventing relative rotational displacement of the inner roller with respect to the outer roller but nonetheless permitting relative reciprocating longitudinal displacement thereof, said reciprocating longitudinal displacement consisting of reciprocating movement of the inner roller with respect to the outer roller in opposite longitudinal directions, said reciprocating movement arrested by a first limit in one direction and a second limit in the opposite direction, the pins as received within their roller locating slots modulating said reciprocating movement between the first limit and second limit according to the sliding travel of the pins within their roller locating slots, the pairs of pins and roller locating slots located on the inner and outer rollers relative to the pairs of inner gas ports and outer gas ports so that each pair of inner gas ports and outer gas ports become co-located when the reciprocating movement reaches a predetermined choice of either the first limit or the second limit;

a chamber divider received into the outer roller, the chamber divider providing a cylindrical recess in one end, a circular pressure plate received into the cylindrical recess, the pressure plate in contact with an aperture control return spring, the pressure plate also rigidly connected to the inner roller; and a hydraulic fluid intake means, the hydraulic fluid intake means available to introduce hydraulic fluid into the cylindrical recess so as to displace the pressure plate and compress the aperture control return spring.

7. The variable roller valve assembly of claim 5, further comprising:

the inner roller having an inner roller surface area, the outer roller having an outer roller surface area, and a heat-resistance coating, the heat-resistant coating applied to a predetermined portion of the inner roller surface area and to a predetermined portion of the outer roller surface area.

8. The variable roller valve assembly of claim 7, wherein the heat resistant coating is of ceramic construction.

9. In an internal combustion engine having at least one combustion chamber whose piston is connected to a crankshaft, a variable roller valve assembly, comprising:

a roller valve assembly;

a linkage means, the linkage means rotatably connecting the roller valve assembly to the engine crankshaft, the linkage means driving the roller valve assembly with torque from the crankshaft while simultaneously synchronizing the rotation of the roller valve assembly with the rotation of the crankshaft;

the roller valve assembly further comprising a roller casing with a roller casing recess provided at one end thereof, a substantially cylindrical phase control casing received into the roller casing recess, the phase control casing having an outer circumference and a first end, a thrust ring means located between the phase control casing and the roller casing at their points of contact;

a splined member received into the phase control casing, the splined member having a first end, the splined member providing splines, the splines being straight and extending longitudinally along the splined member at the first end thereof;

an annular piston slidably received over the splined member, the annular piston in communication with a phase control return spring, the annular piston and the phase control return spring being separated by a sliding collar, the sliding collar also slidably received over the splined member, the sliding collar having an inside cylindrical surface and an outside cylindrical surface, the inside cylindrical surface having internal grooves, the internal grooves slidably engaging the splines on the splined member;

a hydraulic fluid intake means, the hydraulic fluid intake means available to introduce hydraulic fluid into the phase control casing so as to displace the annular piston against the phase control return spring, the displacement of the annular piston also causing the internal grooves of the sliding collar to slide over the splines;

at least one longitudinal phase slot provided in the outer circumference of the phase control casing and at least one helical phase slot provided in the roller casing, the at least one longitudinal phase slot and the at least one helical phase slot provided in corresponding pairs;

each longitudinal phase slot extending straight between a first end thereof and a second end thereof, each longitudinal phase slot also extending longitudinally along the phase control casing;

each helical phase slot extending arcuately between a first end thereof and a second end thereof according to an identical predetermined arc;

the first ends of all longitudinal phase slots and the first ends of all helical phase slots being oriented towards the first end of the phase control casing, each pair of longitudinal phase slots and helical phase slots located on the phase control casing and the roller casing respectively such that the first end of the longitudinal phase slot and the first end of the horizontal phase slot in all corresponding pairs thereof may be simultaneously co-located when the phase control casing is in a predetermined position with respect to the roller casing; and at least one fastener means, the at least one fastener means rigidly connected to the outside cylindrical surface of the sliding collar, one fastener means being provided for each pair of longitudinal phase slots and helical phase slots, the at least one fastener means located on a pitch around the outside cylindrical surface of the sliding collar to match the pitch of the longitudinal phase slots around the outer circumference of the phase control casing, each fastener means rotatably retaining an inner bearing and an outer bearing, each inner bearing being received into one longitudinal phase slot in the phase control casing, each outer bearing being simultaneously received into one helical phase slot in the roller casing.

10. In an internal combustion engine having a fuel intake manifold, an exhaust manifold, and at least one combustion chamber whose piston is connected to a crankshaft, a method of varying the aperture of a roller valve as presented to a combustion chamber therein while the engine is running, comprising the steps of:

receiving an inner hollow tube within an outer hollow tube so that the inner and outer hollow tubes have a substantially common longitudinal axis;

restraining the inner hollow tube from displacement with respect to the outer hollow tube in any direction except along the common longitudinal axis;

rotating the inner hollow tube and the outer hollow tube about the common longitudinal axis with torque from the crankshaft while simultaneously synchronizing said rotation with the rotation of the crankshaft;

providing at least one inner gas port in the inner hollow tube and at least one outer gas port in the outer hollow tube so that the inner gas ports and the outer gas ports are provided in corresponding pairs;

locating the corresponding pairs of inner gas ports and outer gas ports on the inner hollow tube and outer hollow tube respectively so that all pairs of gas ports are fully co-located at a predetermined position of the inner hollow tube with respect to the outer hollow tube along the common longitudinal axis;

positioning the outer hollow tube so that each outer gas port is in gas flow communication with a combustion chamber on the engine at least once during one revolution of the outer hollow tube;

closing off one end of the inner tube and placing the other end of the inner tube in gas flow communication with either (1) the fuel intake manifold or (2) the exhaust manifold; and displacing the inner hollow tube with respect to the outer hollow tube along the common longitudinal axis during rotation thereof;

whereby the degree of co-location of the inner gas ports and the outer gas ports may be varied along the common longitudinal axis as pairs of gas ports are presented to the combustion chamber, thus varying the aperture through which combustion gas can pass between the combustion chamber and the inner hollow tube.

11. In an internal combustion engine having at least one combustion chamber including a piston connected to a crankshaft, a method of varying the rotational phase of a roller valve assembly with respect to the crankshaft while the engine is running, comprising the steps of:

providing a substantially cylindrical roller valve assembly with an outer casing and a longitudinal axis;

providing an open cylindrical recess in one end of the outer casing, said recess sealed from combustion gas communication and sharing a common longitudinal axis with the roller valve assembly;

receiving a cylindrical tube within the recess so that the tube also shares a common longitudinal axis with the recess and the roller valve assembly;

rotating the tube about the common longitudinal axis with torque from the crankshaft while simultaneously synchronizing said rotation with the rotation of the crankshaft;

providing at least one longitudinal slot in the tube, each longitudinal slot extending in a direction parallel to the common longitudinal axis;

providing at least one helical slot in the outer casing, each helical slot extending arcuately around the outer casing according to an identical predetermined arc, the longitudinal slots and the helical slots provided in corresponding pairs;

locating the corresponding pairs of longitudinal slots and helical slots on the tube and on the outer casing respectively so that a portion of each longitudinal slot is always co-located with a predetermined portion of its paired helical slot;

receiving a sliding member within the tube so that the sliding member also shares the common longitudinal axis;

restraining the sliding member from displacement in any direction other than back and forth along the common longitudinal axis;

extending pins fixed to the sliding member through the point of co-location of each pair of longitudinal slots and helical slots; and displacing the sliding member along the common longitudinal axis;

whereby displacement of the sliding member causes displacement of the pins along the arc of the helical slots, which in turn causes relative rotational phase shift of the outer casing with respect to the tube while both assembles are being rotated.

* * * * *